US005352268A

United States Patent [19]

Meguro et al.

[11] Patent Number: 5,352,268

[45] Date of Patent: Oct. 4, 1994

[54] FE-NI ALLOY FINE POWDER OF FLAT SHAPE

[75] Inventors: Takashi Meguro; Hideki Nakamura, both of Yonago; Yoichi Mochida, Yasugi; Tsutomu Inui, Yonago, all of Japan

[73] Assignee: Hitachi Metals, Ltd., Tokyo, Japan

[21] Appl. No.: 19,657

[22] Filed: Feb. 19, 1993

Related U.S. Application Data

[63] Continuation-in-part of Ser. No. 868,212, Apr. 13, 1992, abandoned, which is a continuation-in-part of Ser. No. 619,448, Nov. 29, 1990, Pat. No. 5,135,586.

[30] Foreign Application Priority Data

Dec. 12, 1989 [JP] Japan ..... 1-322365
Apr. 4, 1990 [JP] Japan ..... 2-89705

[51] Int. Cl.[5] ..... H01F 1/047

[52] U.S. Cl. ..... 75/338; 75/348; 148/105

[58] Field of Search ..... 148/104, 105, 312; 75/338, 348

[56] References Cited

U.S. PATENT DOCUMENTS 1,878,589 9/1932 Marris et al. .

FOREIGN PATENT DOCUMENTS 62-23805 of 0000 Japan .
63-35701 of 0000 Japan .
63-45706 of 0000 Japan .
58-59268 of 0000 Japan .
62-123494 of 0000 Japan .
62-54903 1/1987 Japan .
1-294801 11/1989 Japan ..... 148/105
706195 1/1990 U.S.S.R. .

*Primary Examiner*—George Wyszomierski
*Attorney, Agent, or Firm*—Finnegan, Henderson, Farabow, Garrett & Dunner

[57] ABSTRACT

A flat-shaped fine Fe-Ni alloy powder suitable for use as a magnetic shield coating material for cards or the like. The powder has a mean particle size of 0.1 to 30 μm, a mean thickness not greater than 2 μm and a coercive force not greater than 400 A/m. The flat-shaped fine powder is produced by preparing an Fe-Ni alloy powder of a composition which exhibits, in a bulk state, a saturated magnetostriction constant value falling within the range of $\pm 15 \times 10^{-6}$ and which contains, by weight, 70 to 83% Ni, 2 to 6% Mo, 3 to 6% Cu, 1 to 2% Mn, not more than 0.05% C and the balance Fe and incidental impurities, pulverizing the alloy powder by an attrition mill, and annealing the pulverized powder in a fluidized or moving state in a substantially non-oxidizing atmosphere.

13 Claims, 3 Drawing Sheets

FE-NI ALLOY FINE POWDER OF FLAT SHAPE

This application is a continuation in part of application Ser. No. 07/868,212, filed Apr. 13, 1992, now abandoned, and a continuation in part of application Ser. No. 07/619,448, filed Nov. 29, 1990, now U.S. Pat. No. 5,135,586.

BACKGROUND OF THE INVENTION

1. Field of the Invention

The present invention relates to a flat-shaped Fe-Ni alloy fine powder particles superior in soft magnetic characteristic and having a mean particle size of 0.1 to 30 μm, preferably 0.1 to 20 μm and a mean thickness not greater than 2 μm, preferably not greater than 1 μm.

2. Description of the Related Art

In recent years, magnetic cards pertaining to personal secret data, typically bank cards and credit cards, are finding spreading use. In recent years, there has been an increasing demand for these magnetic cards coated by a film of fine powder particles of high magnetic permeability materials. In general, powders used as the coating material are required to be fine in size and high in magnetic permeability. In addition, particles of such a powder are required to be flat. High flatness of the powder particle is required not only from the view points of ease of application and smoothness of the film but also from the fact that the powder particles, under shearing force exerted by a coater, are laid flat in parallel with the card substrate so as to minimize the demagnetization factor thereby to provide a high magnetic permeability in the longitudinal direction of the card surface.

Such coating powder is generally required to have a mean particle size of 0.1 to 30 μm, a mean thickness not greater than 2 μm and a coercive force of 400 A/m or less, preferably 240 A/m or less, in a randomly laid state neglecting demagnetization. The term "thickness" is used in the specification to mean the thickness as measured through a microscopic observation of a cross-section of a specimen resin in which the powder has been embedded while being oriented toward the flat direction through the application of magnetic field and then fixed.

Fe-Ni alloy powders are expected to meet requirements for high magnetic permeability and flatness because these alloys inherently have high levels of magnetic permeability and high levels of plasticity which facilitate flattening by plastic work. Unfortunately, however, no method has been developed for enabling mass-production of Fe-Ni alloy powder which would meet the above-described dimensional specifications and properties.

Japanese Patent Laid-Open Publication Nos. 63-35701 and 63-35706 disclose methods in which flaky metallic powders of high magnetic permeability, having thicknesses not greater than 2 μm and a thickness-to-diameter ratio not greater than 1/10 are produced by wet ball-mill process. More specifically, in one of these methods, pure iron powder particles which have passed a sieve of 44 μm mesh are pulverized for 96 hours so as to become flaky powder of about 1.0 μm thick capable of passing a sieve of 25 μm mesh at a rate of 98%. In the other method, powder particles of Sendust alloy which have passed a sieve of 44 μm mesh are pulverized for 96 hours so as to become flaky powder of about 1.0 to 1.5 μm thick capable of passing a sieve of 25 μm mesh at a rate of 96%.

While it is true that these methods can provide magnetic powder of mean thickness not greater than 2 μm, these methods are still unsatisfactory in that they require a pulverizing step which takes a very long time, i.e., 96 hours and in that they are not suitable for production of fine powders of 30 to 20 μm or finer at a high yield. Furthermore, powders produced by these methods exhibit high levels of coercive force due to strain incurred during pulverizing. For instance, the above-mentioned Fe powder and the Sendust alloy are reported to exhibit high levels of coercive force, say 43 Oe (3440 A/m) and 9 Oe (720 A/m), respectively.

Japanese Patent Laid-Open Publication No. 62-238305 discloses a method for producing flat-shaped Sendust alloy powder in which a Sendust alloy is atomized by water-atomization method into grains of grain sizes not greater than 100 μm and these grains are pulverized into single crystals having longer-dimension-to-shorter-dimension ratio of 10 or greater by means of a crusher having a high energy density. The flaky powder produced by this method also exhibit an impractically high level of coercive force due to strain incurred during the pulverization. This method, therefore, cannot suitably be used for the production of magnetic cards shielding powder to which the present invention pertains.

Japanese Patent Laid-Open Publication No. 58-59268 discloses a method in which Sendust powder which have been formed from an ingot through repeated pulverizing steps are subjected to an annealing in hydrogen atmosphere for the purpose of relief of the pulverizing strain. This Publication, however, fails to definitely disclose the level of the coercive force and does not show any practical method of annealing for reducing coercive force. The methods shown in this Publication, therefore, cannot be used satisfactorily in the production of magnetic card shielding powder to which the invention pertains.

Furthermore, all the Publications mentioned hereinbefore do not mention saturation magnetostriction constant.

No prior art example has been found as to a method of producing flat fine powder of permalloy which is a kind of Fe-Ni alloy. Under these circumstances, the present inventors have proposed, in Japanese Patent Laid-Open Publication No. 63-123494, wherein Fe-Ni alloy powder of a mean particle size not greater than 10 μm is formed by water-atomization and then subjected to a mechanical pulverizing so as to become flat-shaped fine powder of mean particle size ranging between 0.1 and 10 μm and thickness not greater than 1 μm. In this Publication, the inventors have pointed out that the Fe-Ni alloy is easy to flatten due to large plastic workability but is difficult to pulverize into finer size. Thus, the inventors made it clear that, from the view point of pulverizing efficiency, it is important to reduce the particle size of the initial powder.

The method proposed in Japanese Patent Laid-Open Publication No. 01-294801 appreciably facilitates production of flat fine powder particles of Ni alloy. Reduction of the initial particle size, however, is not considered to be a good policy for mass-production from the view point of atomization. Namely, the water-atomizing method, though most suitable for mass-production and most effective in the reduction of particle size among various atomizing methods, requires that the melt of the alloy has to be atomized at a water pressure of 1000 kgf/cm$^2$ or higher when the particle size has to be reduced to 10 μm or below. In consequence, a huge investment is required for installation of piping and a high-pressure water pump, as well as laborious and troublesome maintenance work. In addition, since the beam of the melt has to be restricted to several millimeters in diameter or below, the throughput per unit time is extremely small. In addition, it is not easy to obtain powder of particle size of 10 μm or less at a high yield. Thus, the method proposed in Japanese Patent Laid-Open Publication No. 01-294801 has a drawback in that the mass-production cannot be carried out efficiently when the whole process starting with the preparation of the material powder is considered.

Further, the method of Japanese Patent Laid-Open Publication No. 01-294801 comprises the steps of mixing a non-magnetic refractory material powder with the Fe-Ni based alloy powder, annealing the mixture, and then separating the magnetic Fe-Ni based alloy material by means of magnetic selection. In this method, it is possible to prevent Fe-Ni powder from being coagulated (conglomerated), however, it is impossible to completely separate and remove the non-magnetic refractory material powder from that flat-shaped Fe-Ni based alloy powder because both the non-magnetic refractory material powder and the Fe-Ni based alloy powder are adsorbed each other due to the very fine grain size of 10 μm with respect to the grains of the Fe-Ni based alloy powder.

The existence of some non-magnetic refractory material in the final alloy powder causes a decrease in magnetic permeability even if the flat-shaped Fe-Ni based alloy powder itself has a high magnetic permeability, so that it becomes impossible to obtain the desired product (which is to be used for a magnetic shielding material) having sufficient magnetic shielding ability or effect.

The precursor particles to the flat shaped fine powder particles to which the present invention pertains, namely particles having a mean particle size of 0.1 to 30 μm and mean thickness not greater than 2 μm, are extremely fine and have been heavily strained. Therefore, if this powder were annealed under the same condition as that for usual bulk material, the flat shape attained through pulverizing is impaired due to coagulation of the particle, i.e., sintering. Therefore, the annealing has to be conducted at a temperature which is low enough to prevent the coagulation, much lower than the annealing temperature for the usual bulk material which is generally around 1100° C. Consequently, the conventionally annealing but at lowered annealing temperatures cannot produce any remarkable effect in reducing the coercive force, so that the flat-shaped fine powder produced by the conventional method exhibited a large coercive force of 500 A/m or greater even after an annealing.

SUMMARY OF THE INVENTION

The inventors have found that, by using such a raw material of flat-shaped Fe-Ni based alloy powder as having a particular range of magnetostriction constant value which is measured with respect to the bulk alloy material of the powder, it is possible to reduce the coercive force of the flat-shaped Fe-Ni powder grains in the step of annealing while preventing, without adding non-magnetic refractory material, the powder grains from being coagulated or conglomerated.

Accordingly, an object of the present invention is to provide a flat-shaped fine Fe-Ni alloy powder having a mean particle size of 0.1 to 30 μm and a mean thickness not greater than 2 μm, with coercive force Hc reduced to 400 A/m or below, as well as a method for mass-producing such a powder, thereby overcoming the problems of the prior art.

To this end, according to one aspect of the present invention, there is provided a flat-shaped fine Fe-Ni alloy powder produced by the steps of: preparing an Fe-Ni alloy material having a composition which exhibits, in a bulk state, a saturated magnetostriction constant value falling within the range of $\pm 15\times 10^{-6}$; pulverizing the material into fine powder having a mean particle size of 0.1 to 30 μm and a mean thickness not greater than 2 μm; and effecting an annealing on the fine powder in a non-oxidizing atmosphere without causing substantial change in the shape of the fine powder, so as to reduce the coercive force to a level not higher than 400 A/m. The alloy composition preferably consists, by weight, of 70 to 83% Ni, 2 to 6% Mo, 3 to 6% Cu, 1 to 2% Mn, not more than 0.05% C and the balance Fe and incidental impurities. The composition also may contain, for the purpose of improving pulverizing efficiency, from 0.1 wt % to 2 wt % of one, two or more of elements selected from the group consisting of B, P, As, Sb, Bi, S, Se and Te.

Thus, the present invention provides a flat-shaped fine Fe-Ni alloy powder having a composition which exhibits, in a bulk state, a saturated magnetostriction constant value falling within the range of $\pm 15\times 10^{-6}$, the powder having a mean particle size of 0.1 to 30 μm and a mean thickness not greater than 2 μm and exhibiting coercive force not greater than 400 A/m. The material alloy may be a PC permalloy having the above-specified composition.

The invention also provides a method of producing a flat-shaped fine Fe-Ni alloy powder comprising the steps of: preparing an Fe-Ni alloy material having a composition which exhibits, in a bulk state, a saturated magnetostriction constant value falling within the range of $\pm 15\times 10^{-6}$; pulverizing the material into fine powder having a mean particle size of 0.1 to 30 μm and a mean thickness not greater than 2 μm; and effecting an annealing on the fine powder in a nonoxidizing atmosphere without causing substantial change in the shape of the fine powder, so as to reduce the coercive force to a level not higher than 400 A/m.

In the production method of the present invention, the annealing of the pulverized powder is preferably conducted while the powder is flowing by use of a fluidized bed or otherwise moved, in order to attain a good effect of heat treatment without allowing coagulation of the powder grains.

Preferably, the material to be pulverized contain one, two or more of elements selected from the group consisting of B, P, As, Sb, Bi, S, Se and Te, in an amount ranging between 0.1 and 2 wt %. In order to attain a high pulverizing efficiency, it is possible to take measures such as oxidation of the material powder in an atmosphere having a restrained oxygen potential, i.e., in a weak oxidizing atmosphere, in advance of pulverization, the use of irregularly-shaped material powder obtained through water-atomization of an alloy melt, and execution of pulverization in the presence of a pulverizing aid.

DETAILED DESCRIPTION OF THE INVENTION

Figure 1A:
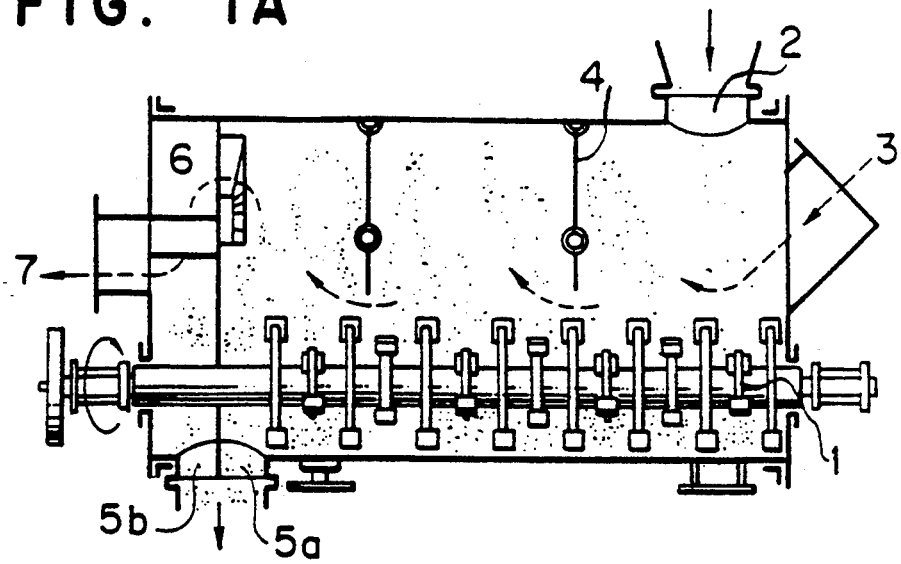
FIGS. 1A, 1B, 2A, 2B and 3 are illustrations of an annealing apparatus suitable for use in carrying out the method of the present invention.

The flat-shaped fine powder of Fe-Ni alloy of the present invention has a mean particle size of 0.1 to 30 μm and a mean thickness not greater than 2 μm, with coercive force Hc reduced to 400 A/m or below as measured in a randomly laid state neglecting the demagnetization field. In order to obtain such a powder, it is preferred that the alloy used as the material is an Fe-Ni alloy the saturation magnetostriction constant of which falls within the range of $\pm 15\times 10^{-6}$ when measured in bulk state, and that the high-temperature annealing is conducted in a nonoxidizing atmosphere so as to avoid coagulation of the powder particle. More preferably, the annealing is conducted while the pulverized powder is made to flow in the form of a fluidized bed or moved by a suitable method.

The method of the present invention for producing flat-shaped fine powder of the present invention essentially has a pulverizing step. There is another method which enables direct production of flattened powder from a molten metal. Such a method, however, cannot produce very thin flat-shaped fine powder. Namely, the thickness of flat-shaped powder produced by such a method is 10 μm or so at the smallest, so that a subsequent process is required to further flatten and to further reduce the powder grain in size. If such particles are post-processed to have a mean particle size of 0.1 to 30 μm and mean thickness not greater than 2 μm, the following processed particles exhibit an extremely large strain due to very large plastic deformation. Obviously, the soft magnetism inherently processed by the material is seriously impaired during the processing. In consequence, the flat-shaped fine powder particles produced by such a method, being thinned and being made to have a mean particle size of 0.1 to 30 μm and mean thickness not greater than 2 μm, exhibit a coercive force which exceeds 500 A/m when measured in a randomly laid state with the demagnetization field neglected. Annealing of the powder is essential in order to reduce the coercive force. The present inventors have found that, in order to reduce the coercive force after the annealing to a level below 400 A/m, it is necessary that the saturation magnetostriction constant of the material falls within the range of $\pm 15\times 10^{-6}$. Measurement of the saturation magnetostriction constant is difficult when the thickness of the measuring object is 2 μm or less as in the case of the powder of the invention. Therefore, the value measured on a sheet of a thickness of millimeter order is used as the value of the saturation magnetostriction constant of the powder material.

More specifically, the material used in the present invention may be a so-called PA permalloy which is a high magnetic permeability alloy having a composition in super lattice forming region of $FeNi_3$ or a composition around this region, or may be multi-element permalloy (so-called PC permalloy) in which the generation of the super lattice is restricted and which is formed by adding to the Fe-Ni alloy various elements such as Mo, Cr, Cu, Nb and Mn to attain a high magnetic permeability even when a gradual cooling is adopted. It is known that the PA and PC permalloys in bulk state produced through melting process can have high magnetic permeability by virtue of the facts that the saturation magnetostriction constant is zero or substantially zero and that the magnetic anisotropy constant is almost zero. The present inventors, however, have found that the flat-shaped fine powder of the invention prepared through pulverizing, when its composition has a saturation magnetostriction constant falling within the range of $\pm 15\times 10^{-6}$, can attain the target coercive force level of 400 A/m or below, since the large residual strain incurred in the pulverizing step can be relieved through the subsequent annealing.

A description will now be given of the reasons of limitation of the contents components of a PC permalloy recommended in the present invention.

It has been known that Fe-Ni alloys exhibit high levels of magnetic permeability when the Ni content is around 80%. In particular, Mo permalloy containing 4 wt % Mo has been widely used. The alloy powder used in the invention is prepared by adding to the above-mentioned permalloy magnetic characteristic-improving elements such as Cu, Mn and/or Mo so as to remarkably increase the magnetic permeability. The alloy does not show required high magnetic permeability when the Ni content is below 70 wt %. On the other hand, magnetization is saturated when the Ni content is increased beyond 83 wt %. For these reasons, the Ni content is limited to range from 70 to 83 wt %. Cu, Mn and Mo are added for the purpose of improving soft magnetism. When the Cu content is below 3 wt %, it is not possible to obtain an appreciable effect regarding the improvement of soft magnetism, particularly in the reduction of coercive force. A Cu content exceeding 6 wt % causes a reduction in the saturation magnetic flux density, as well as a reduction in the magnetic permeability. Mo exhibits the same tendency as Cu. Namely, effect on the improvement of soft magnetism, particularly reduction of the coercive force, is not appreciable when the Mo content is below 2 wt %. Conversely, an Mo content exceeding 6 wt % causes a reduction in the saturation magnetic flux density, as well as a reduction in the magnetic permeability.

Mn, when its content is less than 1 wt %, cannot provide a desired high level of maximum magnetic permeability μmax. On the other hand, an Mn content exceeding 2 wt % undesirably increases the coercive force Hc. An appreciable effect on the increase of the maximum magnetic permeability is obtained when the Mn content ranges from 1 to 2 wt %. The soft magnetism of the alloy is impaired by solid solution of C in the alloy. Presence of C in an amount up to 0.05 wt %, however, is permissible from the view point of soft magnetism or characteristics of the powder. The balance is substantially Fe and incidental impurities. The performance of the alloy powder is not substantially impaired by the presence of up to 1 wt % of Si which is used as a deoxidizer during melting. It has proved that, in order to improve the pulverizing ability of the Fe-Ni alloy having the saturated magnetostriction constant falling within the range of $\pm 15\times 10^{-6}$, the material powder preferably may contain not less than 0.1 wt % but not more than 2 wt % of one or more of elements selected from the group consisting of B, P, As, Sb, Bi, S, Se and Te. It has also been proved that irregularly shaped powder formed by water atomization is preferably used. The degrees of solid solution of the elements such as B, P, As, Sb, Bi, S, Se and Te to the Ni-enriched Fe-Ni alloy as the major composition are essentially zero. These additive elements, therefore, preferentially precipitate during the production of the powder in the grain boundaries as brittle intermetallic compounds such as $M_3B$, $M_3P$, $M_3Sb$, $M_5Sb_2$, MBi, $M_3S_2$, MS, $M_3Se_2$, MTe, $MTe_2$ and their composite phases. These compound phases, though they have variously high or low melting temperatures, are generally very fragile so that the grain boundaries are made fragile to facilitate pulverizing of the material as compared with ordinary Fe-Ni alloy which does not have intentional addition of the above-mentioned elements. Thus, the division of the grains at the boundaries in the initial period of pulverizing step is promoted by the presence of embrittlement phases in the grain boundaries. In addition, the elements added are consumed almost completely in forming these compound phases in the grain boundaries so that the amount of these elements dissolved in the matrix is negligibly small. Therefore, when the saturation magnetostriction constant of the matrix composition is within the range of $\pm 15\times 10^{-6}$, the target coercive force of $Hc \leqq 400$ A/m can be attained without difficulty.

One of the elements such as B, P, As, Sb, Bi, S, Se and Te may be added alone or two or more of these elements may be added in combination. The content of such element or elements in total should be not less than 0.1 wt % but not more than 2 wt %. No appreciable improvement in pulverizing efficiency is attained as compared with the case where the intentional addition of such elements in not conducted, when the total content is less than 0.1 wt %. Furthermore, elements such as P, As, Sb, Bi, S, Se and Te have high vapor pressure at the melting temperature of the matrix composition, so that addition of such elements in excess of 2 wt % is extremely difficult. Although B has a comparatively low vapor pressure, it increases coercive force when added in an amount exceeding 2 wt %. The content of these elements, therefore, should be not more than 2 wt % in total.

The compound phases of these elements formed in the grain boundaries separate from the grain boundaries and are mixed in the powder of the matrix composition during pulverization. These compound phases are then further pulverized and scattered. Some of these phases having low melting point are molten by the heat produced as a result of friction. These compound phases are further molten and scattered during the subsequent annealing, so that the content of the compound phases is finally decreased to a level which does not substantially degrade the magnetic characteristic.

The effect of improving the pulverizing efficiency produced by the addition of one or more of the above-mentioned elements B, P, As, Sb, Bi, S, Se and Te is enhanced when a heat treatment is effected in an atmosphere having restrained oxygen potential in advance of the pulverizing. It is considered that the presence of the brittle grain boundary compound phases generated by the addition of the above-mentioned element or elements reduces the grain boundary energy, so that the material exhibits a greater tendency of selective oxidation at the grain boundaries as compared with ordinary Fe-Ni alloys to which the above-mentioned element or elements are not added. The oxidation tendency at the grain boundaries have not been quantitatively determined yet. It has been confirmed, however, that the pulverizing efficiency is improved when a heat treatment is conducted prior to the pulverizing operation by using, as the above-mentioned atmosphere having restrained oxygen potential, a wet hydrogen of 600° C., as compared with both of the cases where such a heat treatment is not conducted and where heating is conducted in an atmosphere of dry hydrogen. The heat treating atmosphere is not limited to the above-mentioned wet hydrogen, and various gases having weak oxidizing atmosphere with oxygen potential can be used. It is also possible to use inert gases such as nitrogen and argon, as well as $NH_3$ decomposed gas.

The temperature of the heat treatment may be elevated to a level at which the powder particles start to aggregate. Heating to 1000° C. or higher is not recommended because heating to such a high temperature forms a sintered material having a relative density exceeding 70% to thereby reduce the pulverizing efficiency.

Pulverizing of the material can be effected mechanically by means of a stamp mill, vibration mill or attrition mill. In a case of the Fe-Ni alloy powder containing 0.1 to 2 wt % of one or more elements selected from the group consisting of B, P, As, Sb, Bi, S, Se and Te, flat shaped powder of the aimed particle size and thickness can be obtained within 10 hours and at substantially 100% yield, when the pulverizing is effected by an attrition mill which has the highest input energy among various mills. Pulverizing of ordinary Fe-Ni alloy with no addition of the above-mentioned element or elements requires a pulverizing time which is much longer than 10 hours before the powder particle thickness is reduced to the desired value of 2 μm or less.

The effect of shortening of the pulverizing time by the addition of the above-mentioned element or elements also is observed when a pulverizer of a lower input energy is used such as a stamp mill or a vibration mill, although longer pulverizing operation is required when such a pulverizer is used as compared with the attrition mill.

In general, a higher solidification rate at the time of atomizing causes the particle size of the powder to be reduced and allows more uniform fine grain boundary compound phases to crystallize.

The atomization, therefore, is preferably conducted by water atomizing method which provides the highest cooling rate. The use of the water atomizing method also offers the following advantage. Namely, the melt of the alloy is solidified into fine pieces of irregular shape because of the disorder of the melt interface caused by the shearing force of water used as the atomizing medium. Such fine pieces of irregular shape are easier to pulverize as compared with spheroidized powder which is formed, for example, by atomization with a gas.

The flattening is further promoted by conducting the mechanical pulverizing in the presence of a suitable pulverizing aid. The effectiveness of pulverizing aid is illustrated, for example, in the specification of Japanese Patent Laid-Open Publication No. 63-114901, in regard to promotion of pulverizing of amorphous alloy flakes. The above-mentioned specification teaches that the pulverizing aid is adsorbed on the surfaces of the powder particles which are activated as the pulverizing proceeds, so that cohesion of these particles are suppressed by the presence of the pulverizing aid thereby to promote the flattening. The same effect also is observed in the Fe-Ni alloy of the present invention. Examples of solid pulverizing aids suitable for use in the invention are: higher fatty acids such as stearic acid, oleic acid, lauric acid and palmitic acid; metallic soaps such as zinc stearate, calcium stearate, zinc laurate and aluminum laurate; higher fatty alcohols such as stearyl alcohol; higher fatty amines such as ethanolamine and stearylamine; and other materials such as polyethylene wax. One of these substances may be used alone or two or more kinds of these substances can be used in combination. Preferably, the amount of addition of such aids usually ranges between 0.1 and 500 wt %. It is also possible to use a liquid type pulverizing aid such as an organic solvent, e.g., an alcohol, glycol and an ester.

The pulverized powder is classified as required for the purpose of removal of large particles. Presence of large particles makes it difficult to apply the coating material on the substrate such as a magnetic card, and causes fluctuation or lack of uniformity of characteristics. However, no substantial problem in regard to the characteristics is caused when the mean particle size is 30 μm or less.

It is also to be noted that a mean thickness exceeding 2 μm undesirably increases the demagnetization factor in the direction of flatness, with the result that the soft magnetism of the coated film are impaired.

In the present invention, annealing subsequent to the pulverizing is essential because the flat-shaped precursor powder as pulverized still possesses large coercive force exceeding 500 A/m.

If the Fe-Ni alloy fine powder with large strain is annealed under the same condition as that for ordinary bulk material, the flat shape obtained through the mechanical pulverizing is undesirably impaired due to cohesion of the powder particles, i.e., a sintering phenomenon. The annealing, therefore, should be conducted in such a way as to relieve strain without allowing coagulation of the powder particles, thereby to attain good soft magnetism.

In order to prevent coagulation of the powder particles during conventional annealing, it has been necessary to employ an annealing temperature much lower than 1100° C. which is employed generally for annealing ordinary bulk materials. It is impossible to reduce the coercive force of all powders to 400 A/m or below when the annealing is conducted at such a low temperature. Strain-relieving annealing for improvement in soft magnetism is disclosed in the aforementioned Japanese Patent Laid-Open Publication No. 58-59268. This disclosure, however, does not give any idea of overcoming the problem of coagulation during annealing conducted for improving soft magnetism.

The present inventors have found that the soft magnetism can be improved sufficiently even when the annealing is conducted at such temperatures low enough to avoid coagulation, by employing a specific composition range of the alloy.

The inventors also found that a remarkable reduction in the coercive force after pulverizing can be attained without allowing coagulation of the powder particles, when the annealing is conducted in a nonoxidizing atmosphere while making the pulverized flat-shaped fine powder of Fe-Ni alloy flow or move.

Annealing under such conditions can be realized by annealing equipment having a uniform heating zone through which the powder is moved without allowing coagulation of the powder particles. Thus, any equipment can be used which is capable of annealing the powder at a predetermined temperature while agitating and dispersing the fine flat-shaped alloy powder mechanically or by means of a non-oxidizing gas.

Figure 1B:
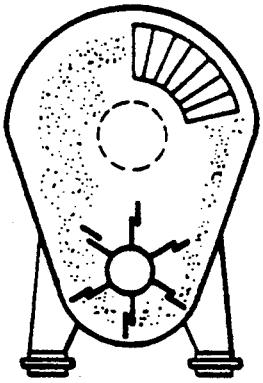
Figure 3:
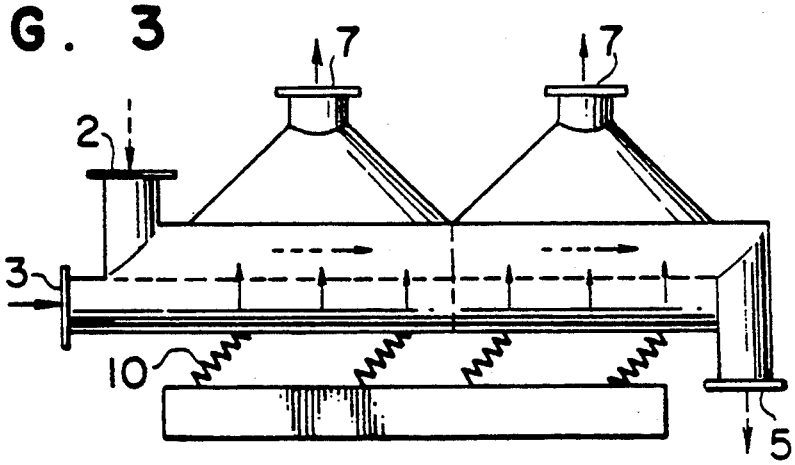
Figure 2B:
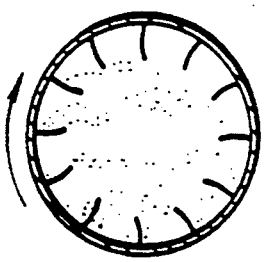
Figure 2A:
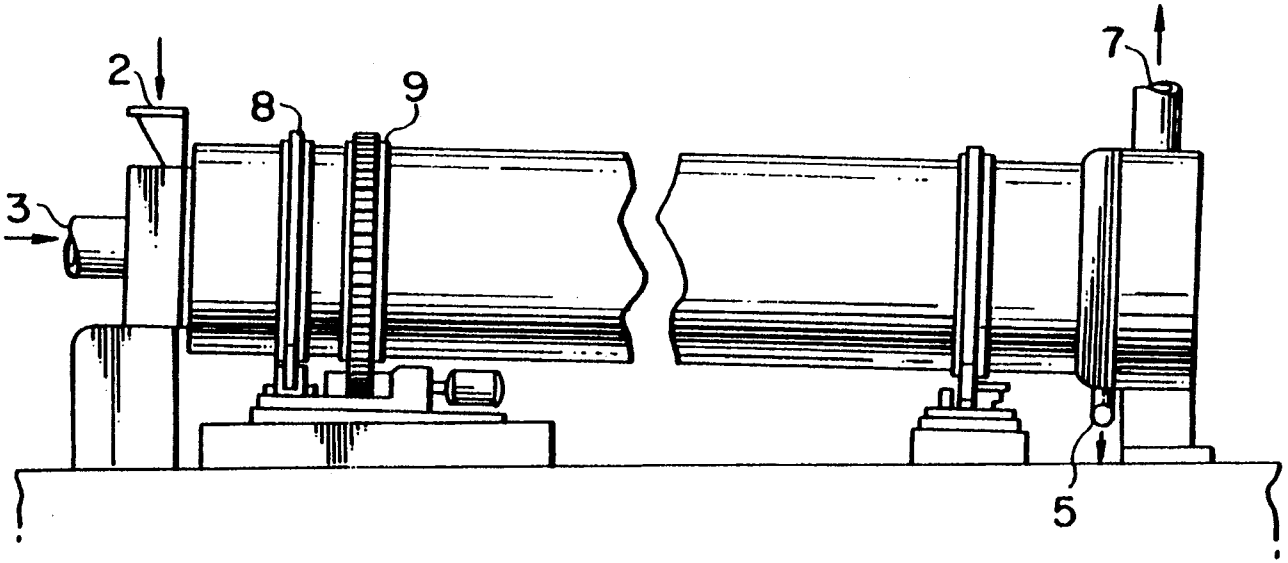

FIGS. 1A and 1B shows an example of an annealing system suitable for use in the present invention. This system has a cylindrical or a channel-like vessel with breadthwise rotary agitating blades. The vessel is charged with the pulverized powder, leaving a vacant space above the charged powder. The powder is continuously heated to be annealed while being agitated by the agitator blades. FIGS. 2A and 2B shows another example of the annealing system in which the pulverized powder and a non-oxidizing gas are charged in counter directions or in parallel into an inclined cylindrical rotary vessel having internal scooping blades. The powder is scooped by the blades and falls in the form of a curtain so as to contact heated non-oxidizing gas. This operation is repeated until the pulverized powder is annealed. FIG. 3 shows an example which is a vibration fluidized bed type. The pulverized powder is fed into a vessel together with a flow of non-oxidizing gas so that a fluidized bed of the powder is formed. The bottom of the fluidized bed is vibrated obliquely so as to promote fluidization and to move the powder. A perforated plate or a screen is suitably used as the bottom plate which supports the fluidized bed. In the systems shown in FIGS. 1 to 3, heating is effected by an internal or external heat source (not shown) arranged to provide a uniform heating zone through the annealing system.

EXAMPLES

EXAMPLE 1

Melts of Fe-Ni alloys of various compositions shown in Table 1 were atomized by a water atomizing method into powder having means particle sizes ranging between 30 and 37 μm. Table 1 also shows the values of the saturation magnetostriction constant λs of these compositions as measured in the bulk state. Each of these six types of water-atomized precursor powders was pulverized in an attrition mill while using JIS-SUJ2 steel balls and isopropyl alcohol as the pulverizing aid. The mixing rate between the SUJ2 steel balls and water-atomized powder was 3:1, and the amount of isopropyl alcohol was the same as that of the water-atomized powder. The mill was operated at 300 rpm for 10 hours so as to pulverize the water-atomized powder. The pulverized powder had a mean particle size of 13 to 16 μm, a mean thickness of 0.7 to 0.7 μm and an apparent density which was 3 to 6% of the true density of the corresponding composition.

Figure 4:
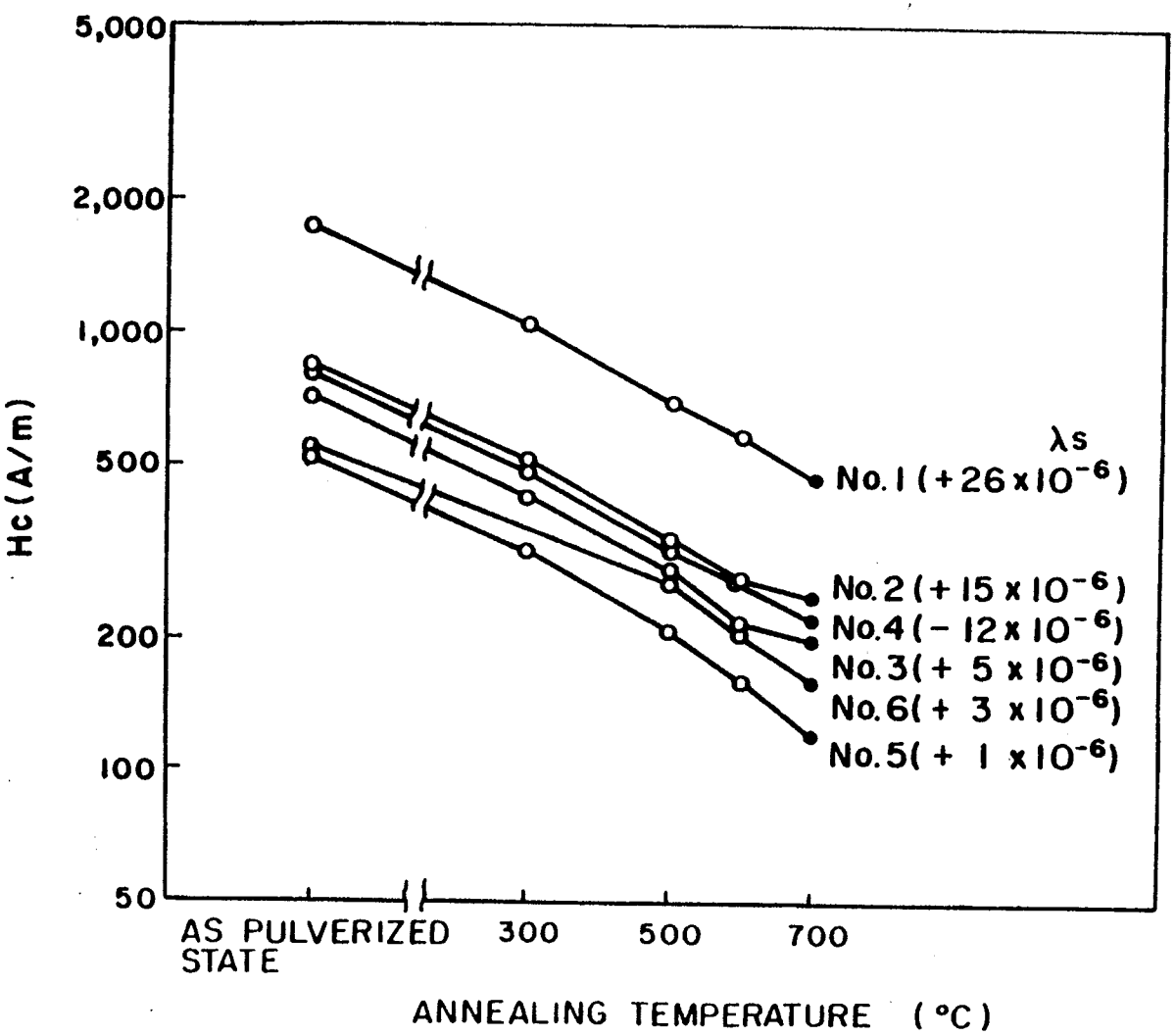
FIG. 4 is a chart showing the relationship between coercive force of pulverized powder and annealing temperature.

After measurement of the coercive force Hc of the pulverized powder, the pulverized powder was annealed in a stream of hydrogen gas in a rotary drum type annealing system of parallel flow type shown in FIG. 2 without adding powdered non-magnetic refractory material, followed by measurement of the coercive force Hc and observation of the shape of the powder. The results are shown in FIG. 4 in which a mark ○ indicates that the shape obtained through the pulverizing was maintained while a mark ● shows that coagulation occurred.

It will be seen that the coercive force Hc measured after the pulverizing and the coercive force Hc measured after the annealing are increased when the deviation (absolute value) of the saturation magnetostriction constant from zero is increased. Only Sample Nos. 3, 6 and 5 can provide the desired coercive force of 240 A/m or below when the annealing is conducted at 600° C. at which coagulation did not start. The values of the saturation magnetostriction constant λs of the powders of Sample Nos. 3, 6 and 5 were $5\times10^{-6}$, $3\times10^{-6}$ and $1\times10^{-6}$, respectively.

TABLE 1

| No. | Composition | Saturation magnetostriction constant λs ($\times 10^{-6}$) |
|---|---|---|
| 1 | Fe—50Ni | +26 |
| 2 | Fe—70Ni | +15 |
| 3 | Fe—80Ni | +5 |
| 4 | Fe—90No | −12 |
| 5 | Fe—80Ni—5.1Mo—0.7Mn | +1 |
| 6 | Fe—77Ni—4.7Cu—1.7Cr | +3 |

EXAMPLE 2

Precursor powders of Sample Nos. 1 to 6 of Example 1 were pulverized by an attrition mill under the same conditions as Example 1, followed by an annealing without the addition of non-magnetic refractory material conducted in a vibration fluidized bed furnace shown in FIG. 3. In contrast to Example 1 in which the annealing was conducted while moving the powder in a rotary vessel, Samples of Example 2 was annealed to reduce the coercive force Hc without suffering coagulation even at an elevated temperature of 700° C. Thus, powders of Sample Nos. 2, 4, 3, 6 and 5 attained the desired coercive force level of 240 A/m or less, whereas Sample No. 1 could not obtain even the value of Hc≦400 A/m. The values of the saturation magnetostriction constant λs of the powders of Sample Nos. 2, 4, 3, 6 and 5 were $15\times10^{-6}$, $-12\times10^{-6}$, $5\times10^{-6}$, $3\times10^{-6}$ and $1\times10^{-6}$ respectively. It is thus understood that the target reduction in the coercive force can be obtained when the saturation magnetostriction constant λs fall within the range of $\pm15\times10^{-6}$.

EXAMPLE 3

Melts of Fe-Ni alloys of various compositions shown in the column of Example 3 of Table 2 were water-atomized into precursor powders of a mean particle size of 31 to 39 μm. These powders were pulverized by an attrition mill, followed by an annealing conducted in a stream of $H_2$ gas, without non-magnetic refractory material addition, for the purpose of reducing the coercive force He. The pulverizing was conducted by charging the attrition mill with a mixture of each water-atomized sample powder, SUJ2 steel and ethanol as the pulverizing aid, and operating the mill at 300 rpm. The mixing ratio between the SUJ2 steel and the water atomized powder was 3:1, while the amount of ethanol was the same as the water atomized powder. Sampling was conducted at every 5 hours and pulverizing was stopped when the mean thickness was reduced down to 1 μm or less. The pulverized powder was then classified with a sieve of 350 mesh, and the yield of the powder which passed the sieve and the mean particle size of the powder were measured. The pulverized powders were also subjected to 1-hour annealing conducted in an atmosphere of hydrogen of 600° C. having a dew point of −60° C., and the coercive force after the annealing was measured. In addition, shapes of the powder particle in the state before the annealing and in the state after the annealing were compared to examine whether any change in shape occurred during the annealing. The annealing system used in this annealing was of the type shown in FIG. 2 having an inclined rotary cylinder with internal scooper blades and employing parallel flow of hydrogen gas and the powder.

TABLE 2

| | No. | Composition | Saturation magnetostriction lambda s (×10−6) | Pulverizing time (hr) | −350 mesh (%) | Mean grain size (mu m) | Hc after annealing (A/m) | Sort |
|---|---|---|---|---|---|---|---|---|
| Example 3 | 11 | 50.2Ni | +26 | 20 | 36 | 22 | 680 | Comparison Example |
| | 12 | 50.5Ni—0.66S | +26 | 10 | 96 | 10 | 720 | " |
| | 13 | 70.5Ni | +15 | 25 | 21 | 28 | 240 | The Invention |
| | 14 | 70.1Ni—0.53S | +15 | 10 | 85 | 13 | 240 | " |
| | 15 | 79.8Ni | +5 | 30 | 16 | 30 | 220 | " |
| | 16 | 80.4Ni—0.08S | +5 | 15 | 93 | 19 | 200 | " |
| | 17 | 80.0ni-0.07P | +5 | 15 | 93 | 18 | 200 | " |
| | 18 | 80.1Ni—0.11S | +5 | 10 | 85 | 17 | 200 | " |
| | 19 | 79.1Ni—0.06P—0.07As | +5 | 10 | 98 | 15 | 200 | " |
| | 20 | 80.6Ni—0.25S—0.10Bi | +5 | 10 | 97 | 12 | 200 | " |
| | 21 | 80.5Ni—0.60S | +5 | 10 | 98 | 9 | 240 | " |
| | 22 | 79.6Ni—0.20Se—0.11Sb | +5 | 10 | 98 | 11 | 200 | " |
| | 23 | 79.3Ni—4.95Mo | +1 | 25 | 52 | 27 | 120 | " |
| | 24 | 79.4Ni—5.06Mo—0.08B | +1 | 10 | 66 | 23 | 140 | " |
| | 25 | 78.7Ni—4.86Mo—0.12P | +1 | 10 | 96 | 17 | 140 | " |
| | 26 | 79.4Ni—4.87Mo—0.59P | +1 | 10 | 98 | 10 | 150 | " |
| | 27 | 78.8Ni—4.78Mo—0.36S—019Te—0.28B—0.13Bi | +1 | 10 | 99 | 5 | 160 | " |
| | 28 | 80.4Ni—5.01Mo—0.60P—0.31S—0.07B | +1 | 10 | 98 | 5 | 160 | " |
| | 29 | 89.9Ni | −12 | 30 | 13 | 34 | 180 | " |
| | 30 | 89.4Ni—0.15S0.06P | −12 | 10 | 76 | 18 | 200 | " |
| Example 4 | 18 | 80.1Ni—0.11S | +5 | 10 | 94 | 14 | 200 | " |
| | 25 | 78.7Ni—4.86Mo—0.12P | +1 | 10 | 99 | 14 | 140 | " |
| Example 5 | 31 | 78.1Ni—3.9Mo—4.8Cu—1.6Mn | +1 | 25 | 57 | 28 | 100 | " |
| | 32 | 78.0Ni—4.2Mo—4.5Cu—1.5Mn—0.7S | +1 | 10 | 95 | 15 | 140 | " |
| | 33 | 78.4Ni—4.0Mo—4.7Cu—1.6Mn—0.3P | +1 | 10 | 91 | 17 | 130 | " |
| | 34 | 79.2Ni—3.1Mo—3.8Cu—1.1Mn | +1 | 25 | 55 | 26 | 110 | " |
| | 35 | 79.4Ni—3.2Mo—3.6Cu—1.1Mn—0.05P—0.06As | +1 | 10 | 89 | 18 | 130 | " |
| | 36 | 79.1Ni—3.2Mo—3.9Cu—1.2Mn—0.05S | +1 | 25 | 59 | 24 | 110 | " |

The columns of Example 3 in Table 2 show the data concerning each tested sample, including the composition excluding incidental impurities, value of the saturation magnetostriction constant λs as measured in the bulk of the same composition produced through a melting process, pulverizing time required till the powder is pulverized down to 1 μm or less in mean thickness, yield and mean particle size of the powder which has passed the 350 mesh sieve, and coercive force Hc of the flattened fine powder after the annealing.

It will be seen that the target condition of coercive force Hc being not greater than 240 A/m after the annealing is obtained regardless of variation in the mean particle size, provided that the saturation magnetostriction constant λs falls within the range of $\pm 15\times 10^{-6}$. However, when the saturation magnetostriction constant λs is $26\times 10^{-6}$, even the value of Hc≦400 A/m cannot be met.

Sample Nos. 14, 18, 19, 20, 21, 22, 15, 26, 27, 28 and 30 had brittle compound phases generated in the grain boundaries in accordance with the invention. It will be seen that these Samples could be sufficiently pulverized in 10 hours and would provide an yield exceeding 75%, as well as a mean particle size not greater than 20 μm, after the classification by the 350 mesh sieve. It will be seen also that the Fe-Ni alloys prepared in accordance with the present invention show a remarkable improvement in the pulverization efficiency as compared with ordinary Fe-Ni alloys, although the value of the saturation magnetostriction constant λs is equal.

Sample Nos. 16 and 17, to which only small quantities of pulverization promoting elements were added, showed a longer pulverizing time of 15 hours. Sample Nos. 11, 13, 15, 23 and 29 also are unsatisfactory in the aspects of the pulverizing time and yield of the −350 mesh.

EXAMPLE 4

Alloys of Sample Nos. 18 and 25, meeting the conditions of the present invention, were water-atomized in the same manner as that in Example 3. In this case, however, the powder was subjected to a heat treatment conducted at 700° C. for 1 hour in an atmosphere of wet hydrogen having a dew point of 30° C., in advance of the pulverizing by an attrition mill. As a result of this heat treatment, the powder was changed into loosely agglomerated pellets having an apparent particle size of about 300 μm.

The pellets were pulverized by an attrition mill under the same conditions as those in Example 3, and measurement was conducted as in Example 3, the result being shown in Column Example 4 in Table 2. It will be understood that, Sample Nos. 18 and 25 showed about 9% and 3% increase in the yield of the −350 mesh after 10-hour pulverizing, as compared with Example 1 which did not employ the heat treatment. The mean particle size after the 10-hour pulverizing also was reduced by 3 μm in both Samples. The levels of coercive force Hc after the annealing, which was carried out without the addition of refractory material, were 200 A/m and 140 A/m, respectively, which were substantially the same as those in Example 1 which did not employed the heat treatment.

EXAMPLE 5

Alloys which were selected from multi-element permalloys (PC permalloys) containing Mo, Cu and Mn. These alloys had compositions which exhibit high magnetic permeability and, hence, were considered to be suitably used in magnetic shielding applications. These alloys were water-atomized into powders having mean grain sizes of 29 to 35 μm. Each powder was pulverized by an attrition mill in the same manner as Example 1, followed by an annealing conducted in a stream of H2 gas for reducing coercive force Hc. Namely, pulverizing was conducted by charging an attrition mill with a 3:1 (weight ratio) mixture of SUJ 2 steel balls and the water-atomized powder, together with isopropylalcohol as the pulverizing aid added in the same amount as the water-atomized powder, and operating the mill at 300 rpm. As in Example 3, sampling was conducted at every 5 hours and pulverizing was stopped when the mean thickness was reduced down to 1 μm or below. Yield and mean particle size were measured in this state. Then, annealing was conducted under the same conditions as Example 3, that is, without the addition of non-refractory material followed by measurement of the coercive force Hc. The column of Example 5 in Table 2 show compositions of these alloys excluding incidental impurities, as well as results of measurement.

A tendency similar to that in Example 3 was obtained. Namely, Sample Nos. 32, 33 and 35, which contained brittle compound phases in the grain boundaries, showed a rapid flattening. Namely, yields exceeding about 90% and mean particle sizes of 20 μm or below were confirmed after the classification through the sieve of 350 mesh.

EXAMPLE 6

Sample powders of mean particle sizes of 25 to 36 μm were produced by water-atomization from melts of various soft magnetism alloys shown in Table 3. Each powder was then pulverized by an attrition mill, followed by an annealing conducted in a stream of H2 gas for reducing the coercive force Hc. More specifically, the attrition mill was charged with a 10:1 (weight ratio) mixture of SUJ 2 steel balls and the water-atomized powder, with addition of isopropyl alcohol as the pulverizing aid by the same volume as the SUJ 2 steel balls. The mill was then operated for 5 hours at 300 rpm. The pulverized powder was sieved through a sieve of 500 mesh, and mean particle size after the sieving was measured. The particle size distribution was measured by laser diffraction method.

The pulverized powder was then annealed at 500° C. for 1 hour while being stationed in a hydrogen atmosphere having a dew point of −60° C., and the coercive force was measured after this annealing. Shape of the powder particle in the state before the annealing and the state after the annealing were compared to check for any change in the shape occurring during the annealing.

A binder was prepared by mixing an acrylate type resin and an urethane resin. The above-mentioned powder after the annealing was mixed with the binder at a ratio of 2:3, so as to form a coating material. The coating material was applied to a polyester substrate in a thickness of 12 to 14 μm. The coercive force Hc and the maximum magnetic permeability μmax in the directions of the substrate surface were measured after the application of the coating material.

Table 3 shows data concerning the tested alloys: namely, major components excluding incidental impurities, saturation magnetostriction constant λs as measured on a melting process type bulk of the same composition, coercive force Hc, maximum magnetic permeability μmax, magnetic flux density $B_8$ under the application of a magnetic field of 8 A/cm, mean particle size after sieving through 500 mesh, coercive force Hc of the flattened fine powder particles after the annealing, and the coercive force Hc and the maximum magnetic permeability in the directions of the substrate surface.

It will be seen that the soft magnetism of the flattened fine powder particles and those observed after application to the substrate have been considerably reduced in comparison with those obtained in the bulk state. This is attributable to shape-magnetic anisotropy developed as a result of flattening and refining, as well as to the fact that the strain incurred during the pulverizing cannot be perfectly removed by annealing conducted at 500° C. which is comparatively low, but this theory is not to be construed as a limitation on the invention defined by the appended claims. It is, however, clear from Table 3 that the magnetic properties as measured in the bulk state of the material influence both the magnetic properties of the flattened fine powder and those of the coat film on the substrate. In other words, materials of the invention which exhibit superior soft magnetism in the bulk state show excellent soft magnetism in the states of the fine flattened powder particles and of the coated film applied on the substrate as compared with materials having compositions other than that of the invention.

From Table 3, it will be seen that the condition of Hc≦240 A/m is met by some of Samples even when the annealing is conducted at the low temperature of 500° C. in a stationary state and the condition of Hc≦400 A/m is cleared by all Samples. It is also understood that a slight reduction of the maximum magnetic permeability μmax is observed both in bulk state and in the coat film when the Ni content does not fall between 70 and 83 wt % as in the cases of Samples 45 and 46. Sample No. 48, the Cu content of which is less than 3 wt %, exhibits a rise in the coercive force Hc, as well as a slight reduction in the maximum magnetic permeability μmax, in all states of bulk, flattened fine powder and coated film. Sample No. 47 containing Cu in excess of 6 wt % shows a significant reduction in the maximum magnetic permeability μmax both in the states of bulk and coat film. Sample No. 49 whose Mn content is below 1 wt % shows small maximum magnetic permeability and high coercive force in all states. Sample No. 50, the Mn content of which exceeds 2 wt %, exhibits a high coercive force level and small value of the maximum magnetic permeability μmax. Sample No. 51 to which Cu has not been added show a low level of the maximum magnetic permeability μmax in all states of bulk, flattened fine powder and coat film. It is understood that the above-mentioned Samples cannot meet the preferred target level of coercive force Hc≦240 A/m, when the annealing is conducted at the low temperature of 500° c., but the requirement of Hc≦400 A/m is met by all these Samples annealed at this low annealing temperature.

From the foregoing discussion, it will be seen that the flattened fine powder having compositions falling within the range specified by the invention exhibit superior soft magnetism such as coercive force Hc and maximum magnetic permeability μmax even in the state of a coat film applied to a substrate, thus proving superior magnetic shielding performance.

TABLE 3

| | | | Characteristics of Materials Having bulk state | | | | Properties of powder | | Properties of coat film | |
|---|---|---|---|---|---|---|---|---|---|---|
| No. | Sort | Composition | lambda s (×10−6) | Hc (A/m) | μmax | $B_8$ (T) | d (Q:μm) | Hc (A/m) | Hc (A/m) | μmax |
| 41 | The Invention | 78.1Ni—3.9Mo—4.8Cu—1.6Mn | +1 | 0.79 | 450,000 | 0.74 | 18.1 | 220 | 334 | 112 |
| 42 | " | 79.2Ni—3.1Mo—3.8Cu—1.1Mn | +1 | 0.80 | 420,000 | 0.74 | 18.0 | 223 | 335 | 109 |
| 43 | " | 78.3Ni—4.1Mo—5.6Cu—1.9Mn | +1 | 0.88 | 460,000 | 0.73 | 18.4 | 225 | 337 | 113 |
| 44 | " | 81.8Ni—5.6Mo—4.5Cu—1.5Mn | +1 | 0.78 | 450,000 | 0.71 | 18.1 | 217 | 331 | 115 |
| 45 | " | 69.0Ni—4.1Mo—5.1Cu—1.6Mn | +12 | 0.97 | 250,000 | 0.80 | 18.2 | 230 | 340 | 62 |
| 46 | " | 84.1Ni—4.0Mo—4.9Cu—1.7Mn | −5 | 0.81 | 300,000 | 0.70 | 17.8 | 225 | 338 | 70 |
| 47 | " | 78.2Ni—3.9Mo—6.2Cu—1.7Mn | +2 | 0.81 | 240,000 | 0.66 | 17.9 | 229 | 335 | 60 |
| 48 | " | 78.3Ni—4.2Mo—2.5Cu—1.5Mn | +2 | 1.29 | 330,000 | 0.76 | 18.6 | 298 | 408 | 73 |
| 49 | " | 78.0Ni—4.1Mo—4.6Cu—0.7Mn | +2 | 0.98 | 290,000 | 0.75 | 17.7 | 250 | 350 | 67 |
| 50 | " | 78.1Ni—3.8Mo—4.9Cu—2.3Mn | +2 | 1.42 | 350,000 | 0.73 | 18.0 | 343 | 470 | 75 |
| 51 | Conventional material | 79.5Ni—4.3Mo—0.5Mn | +2 | 0.96 | 300,000 | 0.80 | 17.8 | 249 | 350 | 72 |

EXAMPLE 7

Water-atomized powder of Sample No. 41 of Example 6 was pulverized by an attrition mill.

More specifically, the water-atomized powder was mixed with SUJ 2 steel balls at a weight ratio of 1:10 and isopropyl alcohol as the pulverizing aid was added to the mixture in the same amount as the SUJ 2 steel balls in terms of volume. Pulverizing was conducted by operating the attrition mill charged with this mixture at 300 rpm. The operation time was varied as 1 hour, 3 hour, 5 hour and 20 hours to vary the thickness and mean particle size of the powder particles. The pulverized powders were classified by sieves of 350 mesh and 500 mesh, and particle size distributions and powder thicknesses were measured.

The thus obtained powders were annealed in a stream of $H_2$ gas without the addition of non-refractory material under the same conditions as Example 6, followed by measurement of the coercive force Hc. The powder was then mixed with a binder and applied to the surface of a substrate, followed by measurement of the coercive force Hc and the maximum magnetic permeability μmax in the directions of the substrate surface.

Table 4 shows the durations of the pulverizing operation, mean particle sizes and mean thicknesses after sieving through 350 and 500 meshes, coercive force Hc of the flattened fine powder after annealing, and coercive force Hc and the maximum magnetic permeability μmax of the coat film measured in the directions of the polyester substrate surface.

TABLE 4

| No. | Sort | Classification condition | Pulverizing time (Hr) | Properties of fine powder: Mean particle size (d) (μm) | Thickness (t) (μm) | Hc (A/m) | Properties of coat film: Hc (A/m) | μmax |
|---|---|---|---|---|---|---|---|---|
| 41 | The Invention | −500 mesh | 5 | 18.1 | 0.9 | 220 | 334 | 112 |
| 52 | The Invention | −500 mesh | 1 | 24.5 | 1.6 | 241 | 451 | 55 |
| 53 | The Invention | −500 mesh | 3 | 22.3 | 1.0 | 208 | 319 | 110 |
| 54 | Comparison example | −350 mesh | 3 | 31.5 | 1.0 | 203 | 301 | 115 |
| 55 | The Invention | −500 mesh | 20 | 10.3 | 0.8 | 289 | 351 | 104 |

Data of Sample No. 52 in Table 4 shows that a mean thickness of the powder particles exceeding 1 μm tends to increase the coercive force and reduce the maximum magnetic permeability μmax after the coating thereof due to an overly large demagnetization field coefficient in the direction of the flattening, and tends also to fail to satisfy the preferred requirement of Hc≦240 A/m.

Sample No. 54, having a mean particle size exceeding 30 μm, could not form a uniform coating film due to difficulty in application, though it showed generally acceptable magnetic properties.

COMPARATIVE EXAMPLE

By using the method of Japanese Patent Laid-Open Publication No. 01-294801 in which a powdered non-magnetic refractory material is mixed with the Fe-Ni based alloy powder before annealing, a flat-shaped powder is obtained by the steps shown below.

Water-atomized powder consisting of 79% Ni, 5% Mo, and substantially the balance Fe and having an average grain size of 5.1 μm was pulverized in an attrition mill in 15 hours under such conditions that the weight ratio of SUJ—2 steel balls relative to the water-atomized powder is 3:1 and that isopropyl alcohol of the same weight as that of the water-atomized powder is added. The grain size distribution and the thickness of the alloy powder obtained after the pulverizing are shown in Table 5. To this alloy powder there was added powder from a melt of $Al_2O_3$ (α-corundum) having an average grain size of about 50 μm, the ratio of the $Al_2O_3$ powder to the alloy powder being 10:1. The resultant mixed powder was annealed for one hour in hydrogen gas at a temperature of 500° C., the annealed powder being then introduced into a magnetic separator of a sensitive roll type to thereby recover the alloy powder. The magnetic separation step was carried out one or three times. In Table 5 there are shown recovery ratios which are defined as the ratio of the weight of the recovered alloy powder to the weight of alloy powder prior to being subjected to the annealing, and the content (volume %) of $Al_2O_3$ included in the recovered substances. Further, in Table 5 there are also shown the recovery ratios of Example 7 of the present invention (that is, the ratio of the weight of the alloy recovered after annealing to the weight of the alloy prior to the annealing) in order to compare them with those of the comparison example, in which Table 5 the numbers of the samples conform to those shown in Examples of the present invention.

As shown in Table 5, in the method of the comparison corresponding to the method of Japanese Patent Laid-Open Publication No 01-294801 in which method a powdered non-magnetic refractory material is mixed with the Fe-Ni based alloy powder, the content of $Al_2O_3$ can be reduced by increasing the number of times the magnetic separation step is carried out; however, at the same time the recovery ratio is also reduced. That is, in the comparison method of the in which the annealing is effected after the adding of non-magnetic refractory material, it is unavoidable that the residue $Al_2O_3$ (which degrades the magnetic characteristics) increases if the recovery ratio is kept at a high level so as to effect the mass-production of the flat-shaped powder. On the other hand, in the method of the present invention there can be obtained both a high recovery ratio and the absence of refractory material which would deteriorate the magnetic characteristics of the alloy powder.

TABLE 5

| No. | Times of magnetic separation | Average grain size (μm) | Thickness (μm) | Hc (A/m) | Recovery ratio (wt %) | $Al_2O_3$ (vol %) | Sample type |
|---|---|---|---|---|---|---|---|
| 56 | 1 | 8.1 | 0.8 | 490 | 92 | 8 | Comparison |
| 57 | 3 | 8.1 | 0.8 | 490 | 87 | 1 | Comparison |
| 41 | — | 18.1 | 0.9 | 220 | ≧99 | 0 | Present Invention |
| 44 | — | 10.3 | 0.8 | 289 | ≧99 | 0 | Present Invention |

As will be understood from the foregoing description, a flats-shaped fine powder of an Fe-Ni alloy, even when the powder particle is extremely flat as represented by a mean particle size of 0.1 to 30 μm and mean thickness not greater than 2 μm, can exhibit a coercive force not greater than 400 A/m through an annealing, provided that the saturation magnetostriction constant λs of the Fe-Ni alloy falls within the range of $\pm 15\times 10^{-6}$. The annealing temperature can be elevated without substantial risk of coagulation of powder particles, if the powder is made to flow or move for agitation and dispersion so as to prevent coagulation. Furthermore, it is possible to obtain flat-shaped fine powder particles or a coated film of such powder satisfying the requirements of magnetic properties, even when the annealing is conducted at a temperature low enough to avoid coagulation, and even without the addition of non-magnetic refractory powder material, provided that the composition of the alloy material is suitably selected.

The present invention, therefore, makes it possible to produce flat-shaped fine powder particles having superior soft magnetism, thus offering a great industrial advantage.

The Fe-Ni alloy composition used in the present invention has a saturation magnetostriction content λs falling within the range of $\pm 15\times 10^{-6}$. One, two or more elements selected from the group consisting of B, P, As, Sb, Bi, S, Se and Te may be added to this Fe-Ni alloy. Using the alloy containing such additive element, it is possible to efficiently produce, on an industrial scale, flat-shaped fine magnetic powder particles having a mean particle size of 0.1 to 30 μm, mean thickness not greater than 2 μm and a coercive force not greater than 400 A/m.

What is claimed is:

1. A method of producing a flat-shaped fine Fe-Ni alloy powder comprising the steps of: preparing a melt of an Fe-Ni alloy material having a composition containing 70 to 90 wt % Ni, not more than 6 wt % Mo, and not more than 6 wt % Cu and which exhibits, in a bulk state, a saturated magnetostriction constant value falling within the range of $\pm 15\times 10^{-6}$; obtaining a precursor powder from said Fe-Ni alloy melt by use of a water-atomizing process; mechanically pulverizing the material into fine powder having a mean particle size of 0.1 to 30 μm and a mean thickness not greater than 2 μm; and effecting an annealing on a portion comprising said fine powder without adding refractory material powder, at a temperature not less then about 300° C. and not more than about 700° C. and in a non-oxidizing atmosphere without causing substantial change in the shape of said fine powder, so as to reduce the coercive force to a level not higher than 400 A/m.

2. The method of producing a flat-shaped fine Fe-Ni alloy powder according to claim 1, wherein the Fe-Ni alloy material contains from 0.1 wt % to 2 wt % of one or more of elements selected from the group consisting of B, P, As, Sb, Bi, S, Se and Te.

3. The method of producing a flat-shaped fine Fe-Ni alloy powder according to claim 2, wherein said Fe-Ni alloy precursor powder is subjected to a heat treatment conducted in an atmosphere having a restrained oxygen potential, in advance of the pulverizing step.

4. The method of producing a flat-shaped fine Fe-Ni alloy powder according to claim 3, wherein the pulverizing is conducted while fluidizing or moving the material powder.

5. The method of producing a flat-shaped fine Fe-Ni alloy powder according to claim 3, wherein the pulverizing step is executed in the presence of a pulverizing aid.

6. The method of producing a flat-shaped fine Fe-Ni alloy powder according to claim 2, wherein the pulverizing is conducted while fluidizing or moving the material powder.

7. The method of producing a flat-shaped fine Fe-Ni alloy powder according to claim 2, wherein the pulverizing step is executed in the presence of a pulverizing aid.

8. The method of producing a flat-shaped fine Fe-Ni alloy powder according to claim 1, wherein the pulverizing is conducted while fluidizing or moving the material powder.

9. The method of producing a flat-shaped fine Fe-Ni alloy powder according to claim 8, wherein the pulverizing step is executed in the presence of a pulverizing aid.

10. The method of producing a flat-shaped fine Fe-Ni alloy powder according to claim 1, wherein the pulverizing step is executed in the presence of a pulverizing aid.

11. The method of producing a flat-shaped fine Fe-Ni alloy powder according to claim 1, wherein the composition consists essentially of 70 to 83 wt % Ni, 2–6 wt % Mo, 3–6 wt % Cu, 1–2 wt % Mn, not more than 0.05 wt % C, balance Fe and incidental impurities.

12. The method of producing a flat-shaped fine Fe-Ni alloy powder according to claim 11, wherein the pulverizing is conducted while fluidizing or moving the material powder.

13. The method of producing a flat-shaped fine Fe-Ni alloy powder according to claim 11, wherein the pulverizing step is executed in the presence of a pulverizing aid.

* * * * *